US006714180B1

(12) United States Patent
Jones

(10) Patent No.: US 6,714,180 B1
(45) Date of Patent: Mar. 30, 2004

(54) AUTOMATIC CONTROL OF GRAY SCALING ALGORITHMS

(75) Inventor: Morris Jones, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/231,321

(22) Filed: Jan. 13, 1999

(51) Int. Cl.[7] ..... G09G 3/36

(52) U.S. Cl. ..... 345/89; 345/88; 345/147; 345/148; 345/149; 345/133; 345/87; 345/589; 345/153

(58) Field of Search ..... 345/89, 148, 149, 345/133, 87, 153, 147, 94, 589

(56) References Cited

U.S. PATENT DOCUMENTS

| | | | | |
|---|---|---|---|---|
| 4,237,457 A | | 12/1980 | Houldsworth | 340/728 |
| 4,612,540 A | | 9/1986 | Pratt | 340/793 |
| 4,849,746 A | | 7/1989 | Dubner | 340/728 |
| 5,136,385 A | | 8/1992 | Campbell | 358/160 |
| 5,254,982 A | * | 10/1993 | Feigenblatt et al. | 345/148 |
| 5,943,036 A | * | 8/1999 | Tanaka | 345/136 |
| 6,043,801 A | * | 3/2000 | Bassetti | 345/89 |
| 6,064,359 A | * | 5/2000 | Lin et al. | 345/89 |
| 6,266,053 B1 | * | 7/2001 | French et al. | 345/302 |

* cited by examiner

*Primary Examiner*—Richard Hjerpe
*Assistant Examiner*—Ali Zamani
(74) *Attorney, Agent, or Firm*—Thelen Reid & Priest LLP; David B. Ritchie

(57) ABSTRACT

A method for developing gray scale pixels on a computer display comprises the steps of examining image content data for display on at least a portion of a computer display to determine whether the image content comprises computer graphics or continuous tone images; and choosing from among spatial and temporal gray scaling for the image content data in response to whether the image content comprises computer graphics or continuous tone images.

21 Claims, 6 Drawing Sheets

AUTOMATIC CONTROL OF GRAY SCALING ALGORITHMS

BACKGROUND OF THE INVENTION

1. Field of the Invention

The present invention relates to video display systems. More particularly, the present invention relates to apparatus and methods for creating gray scale pixels on computer displays.

2. The Prior Art

Display controller devices, such as flat panel controllers use several different methods to develop gray scales on a display. A gray scale represents the different intensities of each of the Red, Green, and Blue pixels in the display. The gray scales for flat panel displays are typically created using a combination of analog techniques in the panel drivers. Known analog techniques include frame rate (temporal) gray scaling, and spatial gray scaling (dithering). Those of ordinary skill in the art understand that the word "gray" is used even though it may relate to shades of Red, Green, or Blue.

Frame rate or temporal gray scaling has been described in the art. This technique trades off video frames for gray scales. It does this by modulating the pixel signal on and off on a per-frame basis. If a display has only two display colors (i.e., black and white), then a pixel may be turned on in every other frame to simulate a 50% gray value. The actual algorithm used in real-world applications is more complex due to the requirements to remove artifacts. This method for creating gray scale works quite well on computer interfaces since the data does not change much, and only contains a few colors in a typical application.

Spatial gray scaling is normally performed by trading pixel resolution on the screen for perceived shades of gray. If it is desired to generate 4 more shades on a display, then a two by two matrix is often used. Spatial gray scaling looks best on continuous tone images. These tend to have a limited bandwidth, but are much more sensitive to color. Spatial gray scaling tends to blur text, and is not recommended for computer graphics.

A typical prior-art display system is called upon to display both computer graphics and continuous tone images. Such a display system achieves colors by both spatial and temporal gray scaling. The result is typically a compromise between requirements for graphics images and requirements for continuous tone images. Gray scale implementations using combinations of both spatial and temporal gray scaling are preselected and fixed into display systems.

BRIEF DESCRIPTION OF THE INVENTION

A method for developing gray scale pixels on a computer display according to the present invention comprises examining a run of pixels in the image content data for display on at least a portion of a computer display, determining whether the image content comprises computer graphics or continuous tone images, and choosing from among spatial and temporal gray scaling to apply to the image content data in response to whether the image content comprises computer graphics or continuous tone images.

According to one embodiment of the present invention, the number of unique colors in a selected run of pixels on the screen are counted to determine whether the image is a computer graphics image or a continuous tone image, and the gray scaling method is adjusted to best match the displayed image.

According to another embodiment of the present invention, the number of times that the same color appears in a selected run of pixels is counted. If the same color appears more than a threshold number of times, the image subject matter is probably computer graphics rather than a continuous tone image.

According to yet another embodiment of the present invention, the frequency content of a selected run of pixels may be determined. If the frequency content of the selected run of pixels is high (e.g., above about 5 MHz) the content is probably computer graphics text. On the other hand, if the frequency content of the selected run of pixels is low (e.g., below about 2 MHz) the content is probably a continuous tone image.

DETAILED DESCRIPTION OF A PREFERRED EMBODIMENT

Those of ordinary skill in the art will realize that the following description of the present invention is illustrative only and not in any way limiting. Other embodiments of the invention will readily suggest themselves to such skilled persons.

Computer displays may comprise text, graphics, or computer generated images. Depending on the content of any given display image, a different gray scaling algorithm may be used, so that the image is displayed in the best form.

A selection of pixels being used to make the determination of the primary content of the display image may comprise a complete frame, a scan line or selected group of scan lines, or an otherwise defined screen region. The gray scaling method is then adjusted according to the determination.

Where the image content determination may be made on the basis of a selected screen region other than a line or a frame, numerous criteria for selecting screen regions may be employed. For example, where multiple windows are displayed in an image frame, the contents of each window may be individually evaluated. Other similar variations of this embodiment are included within the scope of the present invention.

A presently preferred criteria is that a pixel run with a color count of fewer than 30 colors comprises a computer graphics image, and a pixel run with a color count equal to or greater than 30 colors comprises a continuous tone (i.e. photographic) image to a second embodiment of the present invention, the number of unique colors in a selected run of pixels on the screen are counted to determine whether the image is a computer graphics image, a computer generated image, or a continuous tone image, and the gray scaling method is adjusted to best match the displayed image. A presently preferred criteria is that a pixel run with a color count of fewer than 30 colors comprises a computer graphics image, and a pixel run with a color count of greater than 100 colors comprises a continuous tone (i.e. photographic) image. Pixel runs having between 30 and 100 colors are treated as computer-generated images such as those used in games.

Figure 1:
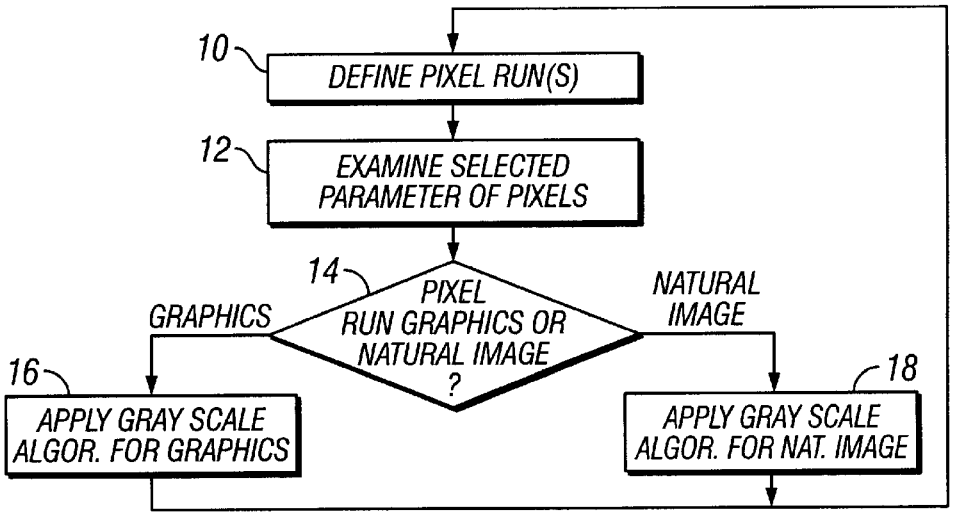
FIG. 1 is a flow diagram of the steps comprising a generic method according to the present invention.

Referring first to FIG. 1, a flow diagram illustrates the steps comprising a generic method according to the present invention. First, a pixel run is defined in block 10. A pixel run is a group of pixels which are to be examined to determine the nature of the image they comprise. According to the present invention, a pixel run may be defined in numerous ways. For example, a pixel run may comprise one or more lines of a display or an entire frame of the display. The pixel run may also comprise a portion of a display such as a window in the display or another region of the display. According to the present invention, more than one run of pixels may be defined. For example, a display comprising a document page of text overlayed by a window containing a photograph (or vise versa) may be contemplated. In the first instance, two runs of pixels may be defined, one comprising the document page of text another comprising the window superimposed on the field. In the second instance, two runs of pixels may also be defined, one comprising the photograph another comprising the window of text superimposed on the photograph.

At block 12 a selected parameter of the pixels in the defined run of pixels is examined as will be disclosed herein. By examining the selected parameter of the pixels in the defined run of pixels, a determination may be made as to whether the image comprising the pixels is a computer graphics image or a continuous tone image. This determination is made at block 14. As will be appreciated by those of ordinary skill in the art, the pixels may be examined while in the pixel pipeline at an early enough stage to enable a selected gray scale algorithm to be applied to them prior to their arrival at the display.

If the result of the inquiry in block 14 is that the image is a computer graphics image, a gray scale algorithm most well suited for computer graphics images is applied at block 16 prior to displaying the pixels. If, however, the result of the inquiry in block 14 is that the image is a continuous tone image, a gray scale algorithm for continuous tone images is applied at block 18 prior to displaying the pixels.

As a result of performing the method illustrated in FIG. 1, switching between more than one gray scale algorithm may be performed "on the fly" during a single display frame so that the individual component image portions of a single frame may be displayed using a gray scale algorithm best suited to the image content.

According to the present invention, the pixels may be examined using one of several criteria. Exemplary pixel examination methods and apparatus are illustrated in FIG. 2 through FIG. 8.

Figure 2:
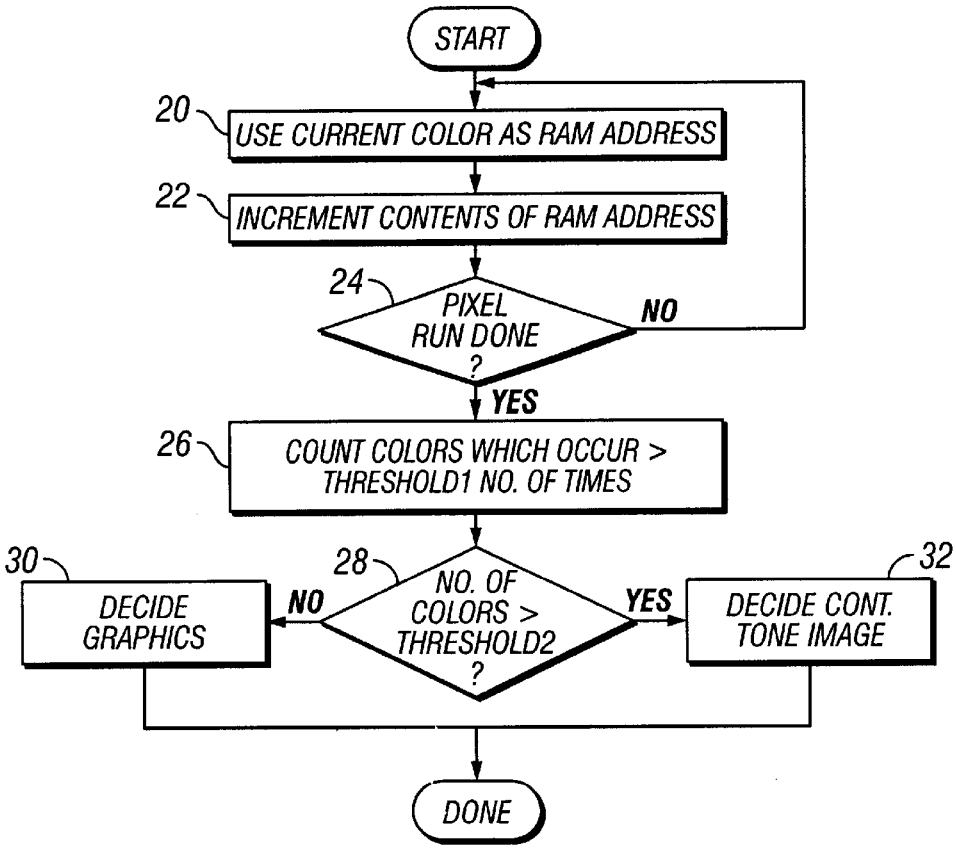
FIG. 2 is a flow diagram of illustrative steps comprising a first method according to the present invention.
Figure 3:
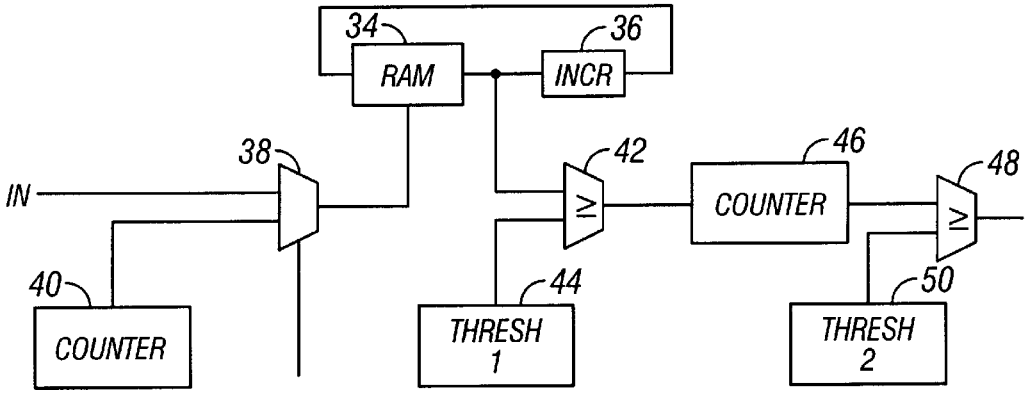
FIG. 3 is a block diagram of a circuit according to a presently preferred embodiment of the present invention according to the method illustrated in the flow diagram of FIG. 2.

FIGS. 2 and 3 together illustrate a first method and apparatus for examining the run of pixels in block 12 of FIG. 1 and determining the nature of the image in block 14 of FIG. 1 are shown. FIG. 2 is a flow diagram of the blocks comprising a first method according to the present invention for examining a run of pixels wherein the number of colors in a selected run of pixels in a display frame are counted to determine whether the image is a computer graphics image or a continuous tone image, and the gray scaling method is adjusted to match the displayed image. FIG. 3 is a block diagram of a circuit according to a presently preferred embodiment of the present invention for counting the number of colors in a selected run of pixels in a display frame to determine whether the image is a computer graphics image or a continuous tone image according to the method illustrated in the flow diagram of FIG. 2. From a description of FIGS. 2 and 3 herein, persons of ordinary skill in the art will appreciate that software or a state machine may be employed to direct the functions of the hardware elements to carry out the process described with respect thereto.

According to the method depicted in FIG. 2, the process begins at block 20 by using the value of the current color as an address for a random access memory. Next, at block 22, the contents of the memory location pointed to by the current color is incremented.

A determination is then made, in block 24, as to whether the pixel just processed was the last pixel in the run of pixels to be processed. If not, process control returns to block 20 to process another pixel. If it is determined that the last pixel processed was the last pixel in the run of pixels, the process proceeds to block 26, in which the number of colors which appear greater than a threshold number of times is determined.

Next, in block 28, the number of colors which appeared a number of times greater than the first threshold is compared with a second threshold value. As presently preferred, this second threshold may be in a range of from about 30 to about 50 colors, and preferably about 40.

If the number of colors is less than a second threshold value, it is determined, at block 30, that the pixel run comprises a computer graphics image, and processing proceeds to block 16 of FIG. 1 to apply a gray scale algorithm suitable for computer graphics images.

If the number of colors is greater than a second threshold value, it is determined, at block 32, that the pixel run comprises a continuous tone image and processing proceeds to block 18 of FIG. 1 to apply a gray scale algorithm suitable for continuous tone images.

Referring now to FIG. 3, one embodiment of an apparatus employing the blocks of the method of FIG. 2 is described. In FIG. 3, the value of the color is used as an address for Random Access Memory (RAM) 34. The contents of the memory location pointed to by the current color is incremented by incrementor circuit 36.

The number of colors which appear greater than a threshold number of times by causing multiplexer 38 to pass the output of counter 40 to the address inputs of RAM 34 rather than the current color value which was previously passed to the address inputs of RAM 34.

The value of counter 40 ranges from 0 to the total number of color values possible in the system. Therefore, for an 8-bit color scheme, the output of counter 40 will range from 0 to 255, since, in an eight bit color scheme, 256 different colors are possible. The output of counter 40 is used to address RAM 34 to access each of the possible color value locations, each color location containing the number of times the color value represented by that memory location appeared in the range of pixels.

For each value of counter 40, the output of RAM 34 is presented to comparator 42, which compares the contents of each address in RAM 34 with a first threshold value, which may be contained, for example, in a register 44. In each instance where the contents of an address in RAM 34 is equal to or greater than the first threshold value, counter 46 is incremented. As presently preferred, this first threshold may be in a range of from about 2% to about 20% of the total number of pixels in the run of pixels, and preferably about 10%. Thus, if you are examining 200 pixels, the first threshold would preferably be a value between about 4 and about 40.

Next, comparator 48 compares the output of counter 46 with a second threshold value, which may be contained, for example, in a register 50. As presently preferred, this second threshold may be in a range of from about 30 to about 50 colors, and preferably about 40.

If the output of comparator 48 is low, indicating that the contents of counter 46 is less than the threshold value contained in register 50, a gray scale algorithm suitable for computer graphics images is applied to the image data. If the output of comparator 48 is high, indicating that the contents of counter 46 is equal to or more than the threshold value contained in register 50, a gray scale algorithm suitable for continuous tone images is applied to the image data.

One method of determining the type of image being analyzed is to count the number of unique colors, and make a decision based only upon that count. Those of ordinary skill in the art will readily recognize that many different ways exist with which to count the number of unique colors. One method utilizing the embodiment of FIG. 3 is to set the first threshold to 1, thus allowing counter 46 to count the number of unique colors present in the image. Threshold 2 would then represent the decision point. Thus, a number of unique colors lower than threshold 2 would represent a computer graphics image, and a higher number of unique colors would represent a continuous tone image.

Figure 4:
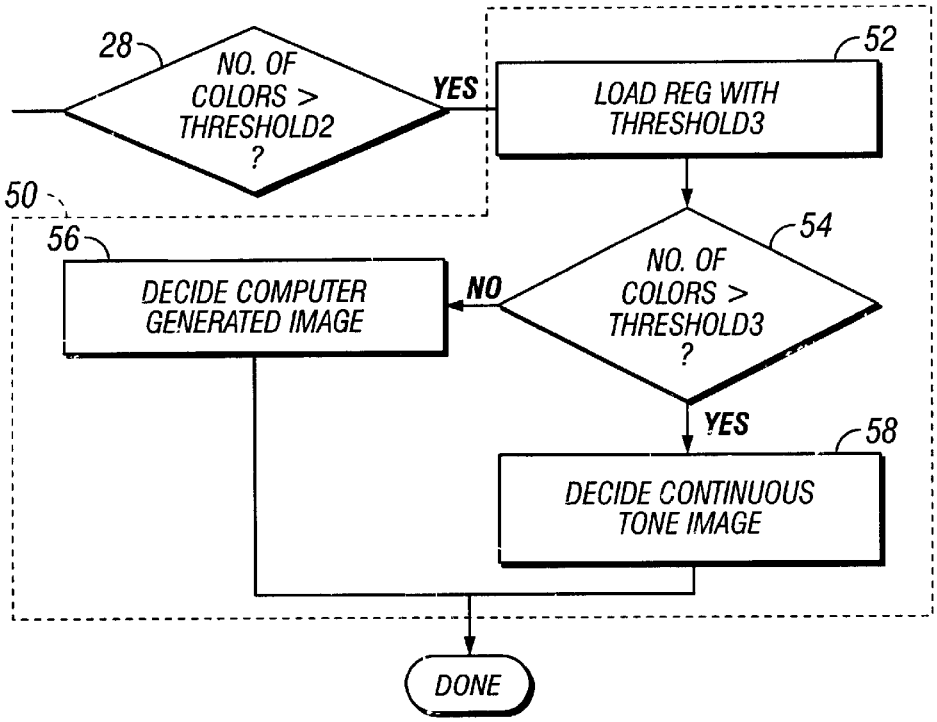
FIG. 4 is a flow diagram of illustrative steps which may be inserted in place of step 32 of FIG. 2.

FIG. 4 is a flow diagram of illustrative blocks which may be inserted in place of block 32 of FIG. 2 to determine whether an image is a continuous tone image, or a computer generated image.

Referring to FIG. 4, instead of block 32 deciding that the image being analyzed comprises a continuous tone image, block 32 is modified to comprise additional blocks which provide for choosing between continuous tone images and computer generated images.

Recall that block 32 is performed when the number of colors appearing more than a threshold number of times in a run of pixels exceeds a predetermined value. Therefore, at this point, it has been determined that the image being analyzed is not a graphics image. Using the method of FIG. 4, it is possible to further determine whether the image is either of a continuous tone image, or a computer generated image.

At block 52, a register (such as register 46 seen in FIG. 3) may be loaded to contain a third threshold value which represents the value at which continuous tone images may be separated from computer generated images. The third threshold will be most likely be in a range of 80 to 120 colors, preferably about 100.

At block 54, the number of colors appearing greater than a threshold number of times is compared to the third threshold value to determine if the number of colors is less than the third threshold amount. If yes, the number of colors is between 30 and 100, and the method proceeds with block 56 where the proper gray scale algorithm for a continuous tone image is applied to the image data. If no, the method proceeds with block 58 where the proper gray scale algorithm for a computer generated image is applied to the image data.

Figure 5:
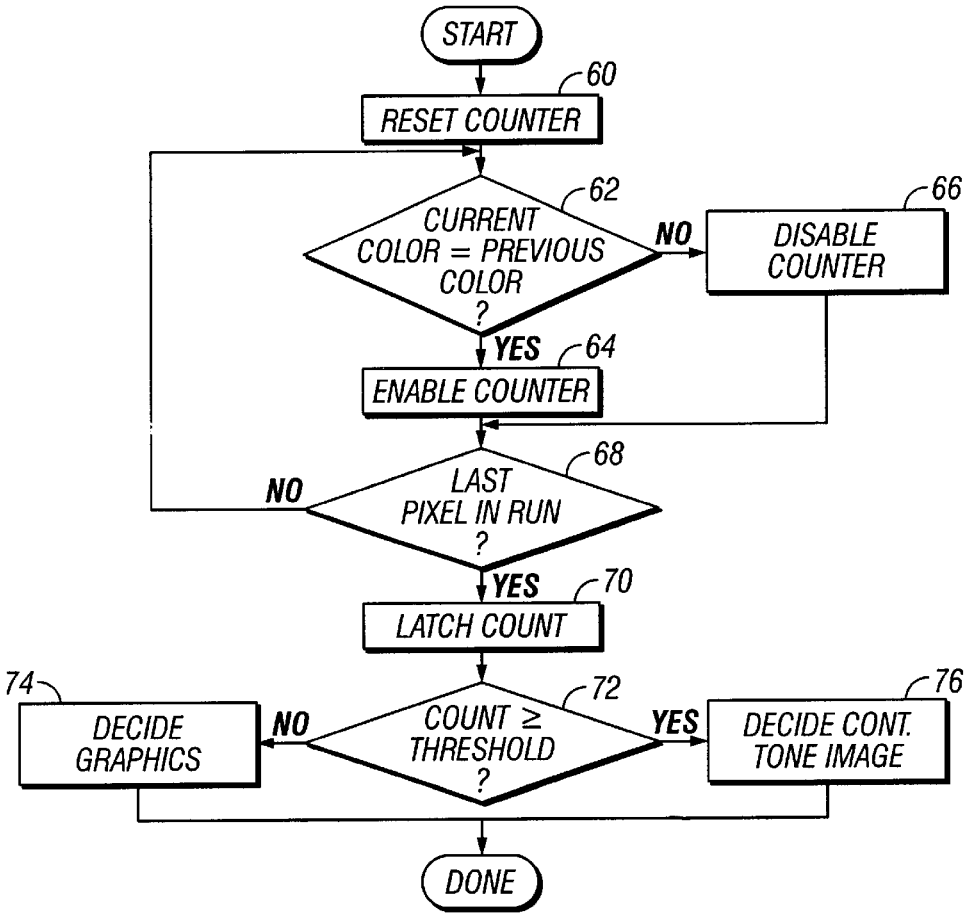
FIG. 5 is a flow diagram of illustrative steps comprising a second method according to the present invention.
Figure 6:
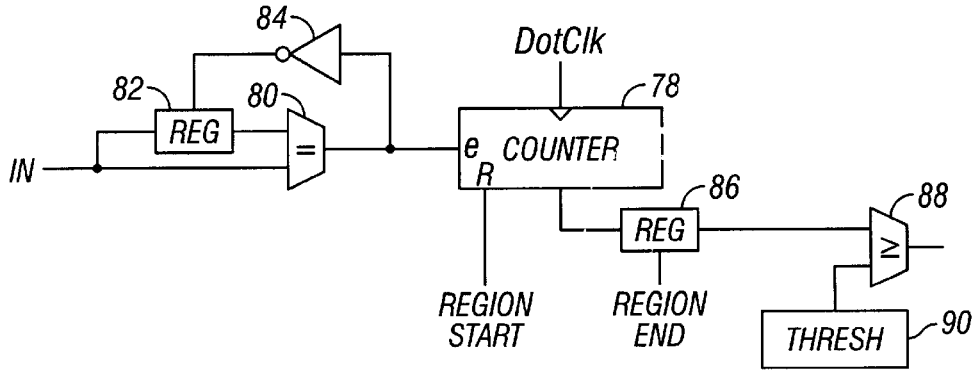
FIG. 6 is a block diagram of a circuit according to a second embodiment of the present invention according to the method illustrated in the flow diagram of FIG. 5.

FIGS. 5 and 6 depict a second illustrative method and apparatus for examining the run of pixels in block 12 of FIG. 1 and determining the nature of the image in block 14 of FIG. 1 are shown. FIG. 5 is a flow diagram of the blocks comprising a second method according to the present invention for examining the run of pixels wherein the number of times that a selected color appears in a selected run of pixels in a display frame is counted, and the gray scaling method is adjusted to best match the displayed image. FIG. 6 is a block diagram of a circuit according to a second embodiment of the present invention for counting the number of times that a selected color appears in a selected run of pixels in a display frame according to the method illustrated in the flow diagram of FIG. 5. As with the other embodiments described herein, persons of ordinary skill in the art will appreciate that software or a state machine may be employed to carry out the process described with respect thereto. From a description of FIGS. 5 and 6 herein, persons of ordinary skill in the art will appreciate that software or a state machine may be employed to direct the functions of the hardware elements to carry out the process described with respect thereto.

The method of FIG. 5 begins at block 60, where a counter which will ultimately count the number of occurrances of colors is reset to a zero value. Next, at block 62, the current color value is compared with the previous color value. If the current color value and the previous color value are equal, at block 64 the counter is enabled and incremented. If the current color value is not equal to the previous color value, at block 66 the counter is disabled and not incremented.

Next, at block 68, a determination is made whether the last pixel evaluated was the last pixel in the run of pixels being examined. If not, process control is returned to block 62 to evaluate the next incoming pixel. If, at block 68, it is determined that the last pixel evaluated was the last pixel in the run of pixels being examined, the process proceeds to block 70, where the counter value is optionally latched.

At block 72, it is determined whether the final counter value is equal to or greater than a preselected threshold. If no, it is determined, in block 74, that the pixel run comprises a computer graphics image, and processing proceeds to block 16 of FIG. 1 to apply a gray scale algorithm suitable for computer graphics images. If yes, it is determined, at block 76, that the pixel run comprises a continuous tone image and processing proceeds to block 18 of FIG. 1 to apply a gray scale algorithm suitable for continuous tone images.

Using the apparatus of FIG. 6, the one embodiment employing the method of FIG. 5 is represented, the apparatus operation beginning when counter 78 is reset to a zero value. Next, the current color is compared in comparator 80 with the contents of register 82. As may be seen from an examination of FIG. 6, register 82 is loaded with the value of the current color via a load clock from the output of inverter 70 whenever comparator 80 determines that the current color is not the same as the previous color.

The output of comparator 80 is also connected to the enable input of counter 78 and will therefore either enable or disable counter 78, depending on the results of the comparison between the current color and the stored color in register 82. Counter 78 is clocked by the system dot clock. Those of ordinary skill in the art are readily aware that a dot clock is a clock which controls the timing of the display of information on a video screen, thus synchronizing the retrieval of information from video memory, and the actual display of that information. Thus the frequency of a dot clock will be higher for higher display resolutions, and lower for lower display resolutions.

If comparator 80 has determined that the current color is the same as the previous color, counter 78 is enabled and is incremented. If comparator 80 has determined that the current color is not the same as the previous color, counter 78 is disabled and is not incremented and register 82 is loaded with the value of the current color.

If the pixel just examined is the last pixel in the region being examined, the value of counter 78 is latched into register 86.

Next, comparator 88 determines whether the latched count stored in register 86 is equal to or greater than a preselected threshold value stored in register 90.

If the output of comparator 88 is low, indicating that the contents of register 88 are less than the threshold value contained in register 90, a gray scale algorithm suitable for computer graphics images is applied to the video data. If the output of comparator 88 is high, indicating that the contents of register 86 is equal to or more than the threshold value contained in register 90, a gray scale algorithm suitable for continuous tone images is applied to the video data.

The threshold set in register 90 is preferably selected to be between about 20% and about 70% of the total number of pixels in the run of pixels being evaluated, but preferably about 50%. Persons of ordinary skill in the art will appreciate that, over a selected pixel run, the contents of counter 78 will be much higher for computer graphics images, which contain long runs of a solid background color. Continuous tone images ostensibly having large same-color background areas should inevitably contain a certain amount of noise which will cause the background color to vary. Noise-induced variations, even as small as one color shade, will affect the final count of counter 78.

Figure 7:
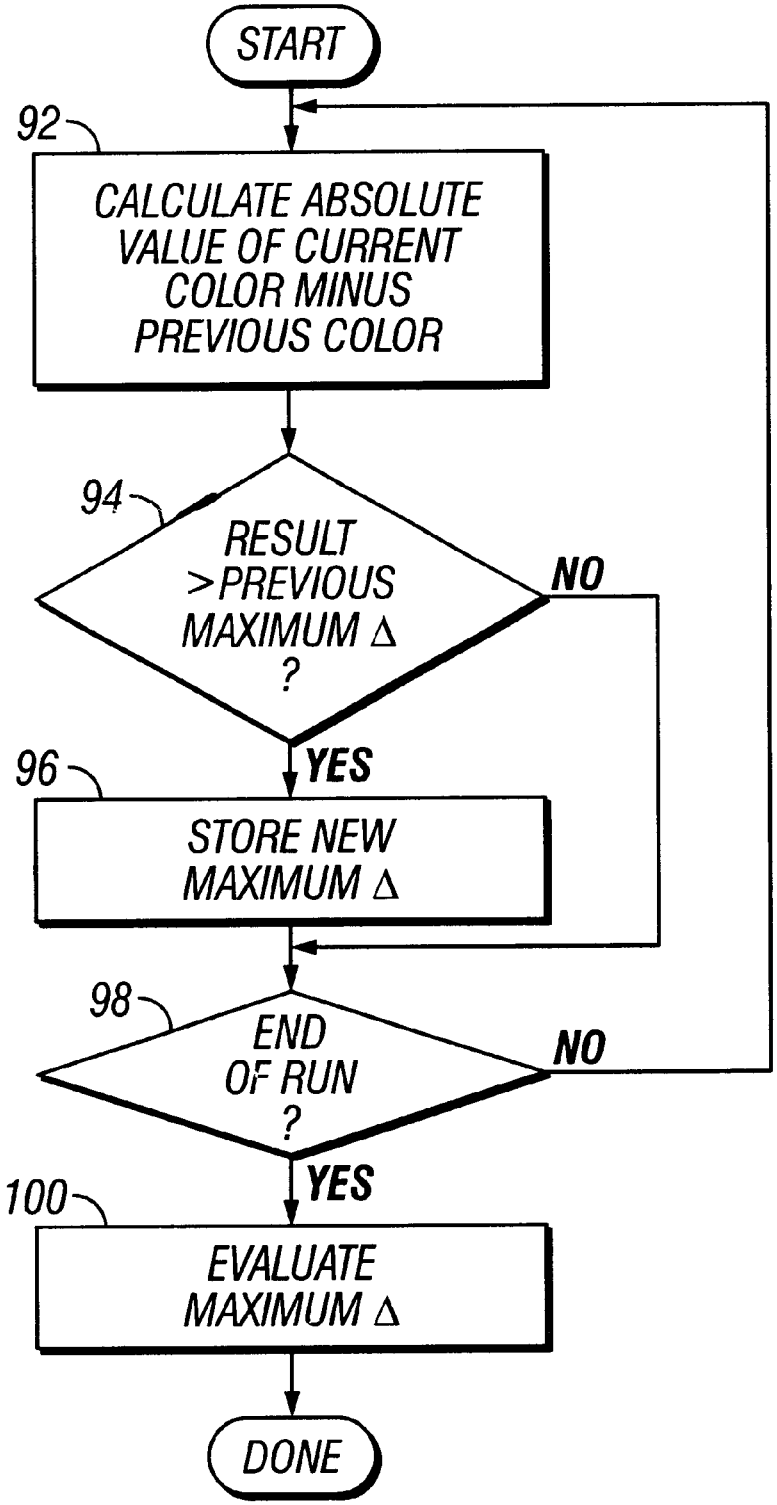
FIG. 7 is a flow diagram of illustrative steps comprising a third method according to the present invention.
Figure 8:
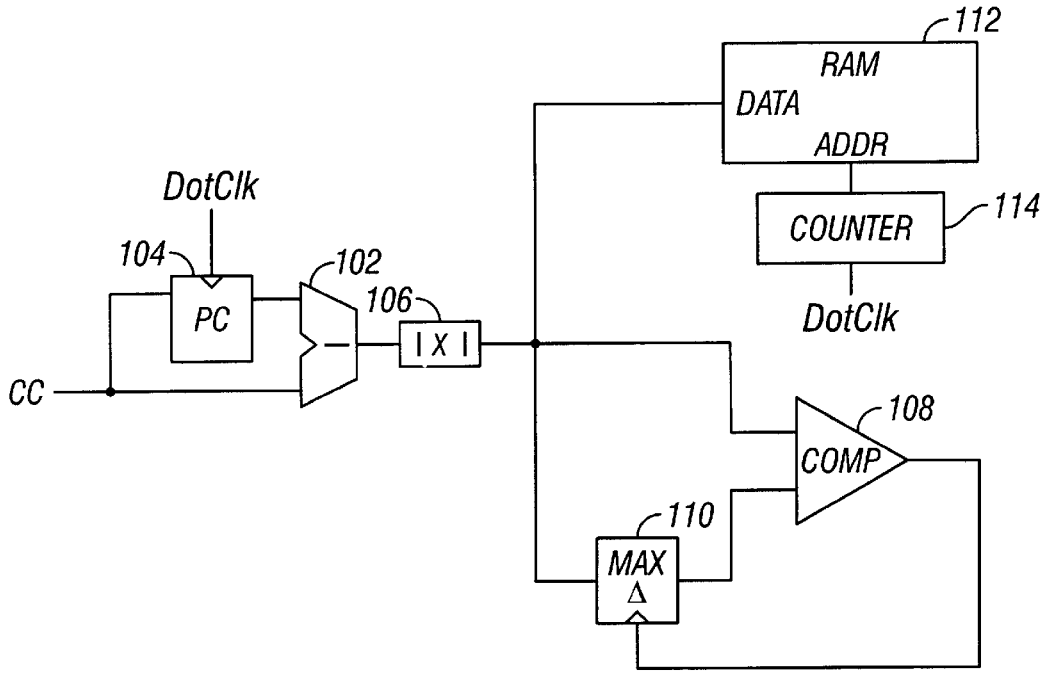
FIG. 8 is a block diagram of a circuit according to a third embodiment of the present invention according to the method illustrated in the flow diagram of FIG. 6.

Referring now to FIGS. 7 and 8 taken together, a third illustrative method and apparatus for examining the run of pixels in block 12 of FIG. 1 and determining the nature of the image in block 14 of FIG. 1 are shown. FIG. 7 is a flow diagram of illustrative blocks comprising a third method according to the present invention for examining the run of pixels wherein the frequency content of a selected run of pixels in a display frame is determined, and the gray scaling method is adjusted to best match the displayed image. FIG. 8 is a block diagram of a circuit according to a third embodiment of the present invention for evaluating the frequency content of a selected run of pixels in a display frame according to the method illustrated in the flow diagram of FIG. 7. From a description of FIGS. 7 and 8 herein, persons of ordinary skill in the art will appreciate that software or a state machine may be employed to direct the functions of the hardware elements to carry out the process described with respect thereto.

The method begins at block 92, where the absolute value of the difference between the color of the current pixel and the color of the previous pixel is determined. The method for computing an absolute value is well known to those of ordinary skill in the art.

Next, at block 94, the absolute value calculated in block 92 is compared with the previous maximum absolute value determined during the current pixel run. If this is the first absolute value computed for the current pixel run, the current value is necessarily greater than the previous maximum.

If the current absolute value is greater than the previous maximum absolute value, the new maximum value is stored, as in block 96. After storing the new maximum value, or if the current absolute value is less than or equal to the previous maximum value the process proceeds with block 98, where it is determined if the most recently evaluated pixel was the last pixel in the run of pixels to be evaluated.

If the current pixel was not the last pixel in the run of pixels, the process returns to block 92 to evaluate the next incoming pixel in the run of pixels being examined. If the current pixel was the last pixel in the run of pixels, the process proceeds to block 100, where the maximum absolute value determined during the pixel run is evaluated.

There are several methods which may be employed to evaluate the maximum absolute value to determine whether the pixel run contain computer graphics image or a continuous tone image. The first method comprises a simple evaluation of the magnitude of the maximum absolute value of the difference between adjacent pixels in the run of pixels.

According to one method of the present invention for performing the process of block 100, the instantaneous slope values are examined. Computer graphics images are expected to contain large numbers of zero values and small numbers of high values which occur at pixel color transitions at the edges of characters. On the other hand, continuous tone images are expected to contain large numbers of small to medium values and very few large values.

Referring now to FIG. 8, one embodiment apparatus for performing the method of FIG. 7 is described.

Subtractor circuit 102 determines the absolute value of the difference between the color of the current pixel and the color of the previous pixel. One input to subtractor circuit 102 is the current color value, and the other input is the previous color value. The previous color value is held in register 104, clocked by the system dot clock. Absolute value circuit 106 strips the subtraction result of any minus sign as is well known in the art.

Next, comparator 108 compares the output of absolute value circuit 106 with the previous maximum absolute value determined during the current pixel run stored in register 110.

The output of comparator 108 is used as a clock input to register 110. This arrangement assures that register 110 will only be clocked if the output of absolute value circuit 106 is greater that the current contents of register 110. Thus, if the output of absolute value circuit 106 is greater than the current value contained within register 104, register 104 is clocked. If the output of absolute value circuit 106 is less than or equal to the current value contained within register 110.

If the current pixel was not the last pixel in the run of pixels, the process repeats with new pixel data. If the current pixel was the last pixel in the run of pixels, the maximum absolute value determined during the current pixel run stored in register 110 is evaluated.

To provide additional flexibility in evaluating the run of pixels, a random access memory 112 may be provided to store each absolute value of the difference (instantaneous slope) between adjacent pixels in the run of pixels. Such a RAM 112 may be addressed by a counter 114 which is incremented by the system dot clock. The data is provided from the output of absolute value circuit 106 and may be written into RAM 112 when the incremented address from counter 114 becomes valid. Counter 114 is reset at the beginning of each pixel run.

There are several methods which may be employed to evaluate the maximum absolute value to determine whether the pixel run contain computer graphics image or a continuous tone image. The first method comprises a simple evaluation of the magnitude of the maximum absolute value of the difference between adjacent pixels in the run of pixels.

Figure 9A:
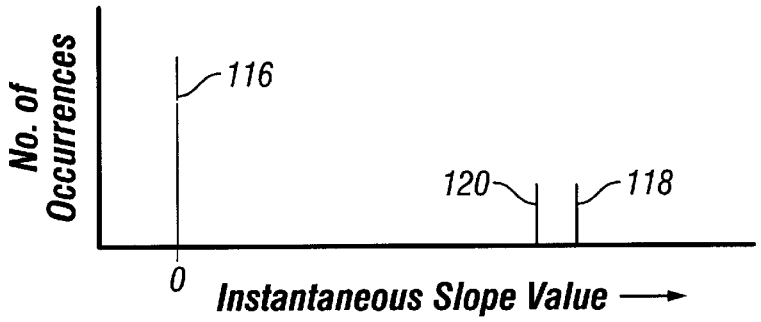
FIGS. 9*a* and 9*b*, respectively, are graphs illustrating typical distributions of instantaneous slope values of color differences between adjacent pixels for computer graphics images and continuous tone images, respectively.
Figure 9B:
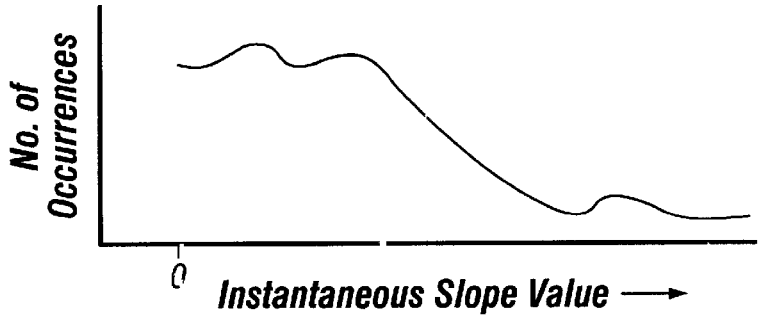

FIGS. 9*a* and 9*b*, respectively, are graphs illustrating typical distributions of instantaneous slope values for computer graphics images and continuous tone images, respectively. In both FIGS. 9*a* and 9*b*, the X-axis represents the instantaneous slope value and the Y-axis represents the number of occurrences of a particular instantaneous slope value.

Referring now to FIG. 9*a*, the presence of a large number of zero values is observed at reference numeral 116, indicating no change between adjacent pixels indicative of the presence of large areas of continuous background color, accompanied by a smaller but significant number of a single larger value at reference numeral 118, indicating high-contrast changes between adjacent pixels indicative of transitions between background color and a single text color. Also shown in FIG. 9*a* at reference numeral 120 is the occurrence of a significant number of occurrences of a second different but also larger value, indicating the presence of two-color text in the pixel run. The difference in positions between the spike at reference numeral 118 and the spike at reference numeral 120 represents the difference in color between the background color and the first text color and the difference in color between the background color and the second text color.

Referring now to FIG. 9*b*, a more even distribution of instantaneous slope values is shown, indicating that the run of pixels comprises a portion of a continuous tone image.

A comparison of the distributions of the instantaneous slopes as seen in FIGS. 9*a* and 9*b* demonstrates the ease with which the two different kinds of images represented therein may be determined.

One method according to the present invention employs a random access memory arrangement like the one shown in FIG, 3, except that the instantaneous slope values are used as addresses to the RAM. The value in each location in the RAM is incremented by an incrementor circuit each time it is addressed. When all of the instantaneous slope values in the RAM 112 of FIG. 8 have been used to address this additional RAM, its contents are evaluated. According to one aspect of the present invention, if the contents of a number of addresses in the RAM are greater than a threshold value contain zero, a decision is made that the pixel run comprised a computer graphics image. According to another aspect of the present invention, the presence of a large number of instantaneous slope values in a small number of single addresses higher than an address representing a threshold contrast value in combination with zero contents at a number of address locations greater than a threshold value, a decision is made that the pixel run comprised a computer graphics image. Other algorithms which operate on this data will be apparent to those of ordinary skill in the art from this disclosure.

Once the determination has been made according to the present invention whether the selected pixel run comprises computer graphics or continuous tone image, one of a plurality of gray scale algorithms may be applied to the pixel data while it is still in the pixel pipeline on the way to the display. Thus, switching between two or more gray scale algorithms may be performed on the fly in the pixel pipeline according to the present invention.

Figure 10:
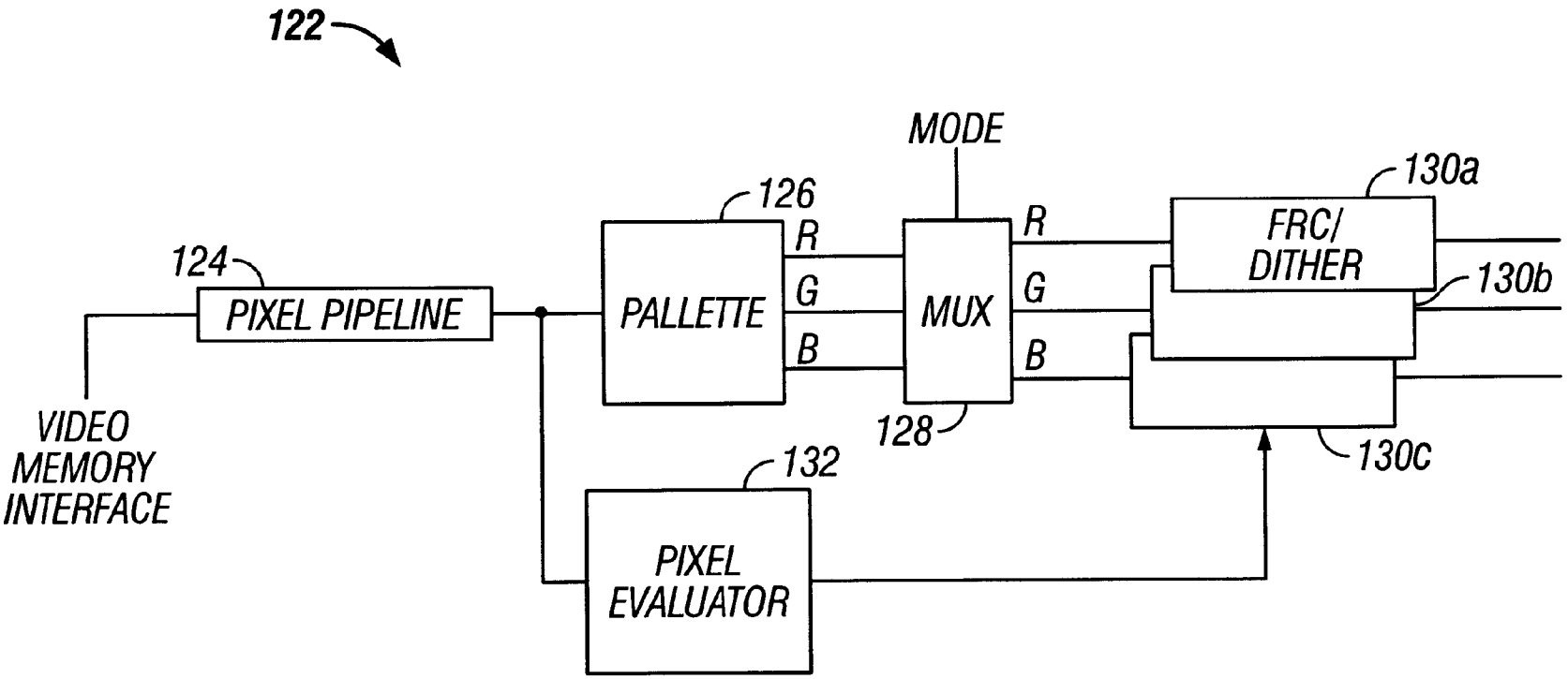
FIG. 10 is a block diagram of an illustrative overall architecture of a system for on-the-fly switching between two or more gray scale algorithms in the pixel pipeline according to the present invention.

Referring now to FIG. 10, a block diagram is presented of an illustrative overall architecture of a system 122 according to the present invention for on-the-fly switching between two or more gray scale algorithms in the pixel pipeline. Pixel data conventionally enters a pixel pipeline 124 from a video memory interface (not shown) as is known in the art. Palette 126 converts the pixel data into RGB color components. Multiplexer 128 further processes the pixel data depending on the color space format in which the data is presented.

The individual R, G, and B pixel data from multiplexer 128 is presented to gray scale algorithm implementing circuits 130*a*, 130*b*, and 130*c*, respectively in accordance with the present invention. Unlike prior art schemes for implementing gray scale algorithms which are fixed at the time of manufacture of the video controller or accelerator containing them, circuits 130*a*, 130*b*, and 130*c* are capable of implementing either frame rate control (FRC) gray scale algorithms or spatial dithering, both techniques being well known to persons of ordinary skill in the art.

According to the present invention, pixel evaluator 132 taps the pixel stream at an appropriate point, such as just prior to palette 126.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method for developing gray scale pixels on a computer display, the method comprising:

examining image content data using the number of colors used for display on a computer display to determine whether said image content is likely to be computer graphics or likely to be continuous tone images; and choosing from among spatial and temporal gray scaling for said image content data in response to whether said image content comprises computer graphics or continuous tone images.

2. The method of claim 1 wherein said examining further comprises determining the number of unique colors in a selected run of pixels in a display frame, identifying the image as a computer graphics image if the number of unique colors is less than a first threshold amount, and identifying the image as a continuous tone image if the number of unique colors is greater than a second threshold amount.

3. The method of claim 2 wherein said first threshold amount lies in a range between about 10% and about 20% of the number of pixels in said selected run of pixels and wherein said second threshold amount lies in a range between about 50% and about 100% of the total number of colors available in the color scheme being used in the system.

4. The method of claim 3 wherein said selected run of pixels comprises substantially an entire frame.

5. The method of claim 3 wherein said selected run of pixels comprises substantially all pixels of at least one line in said frame.

6. The method of claim 3 wherein said selected run of pixels comprises a portion of a window in said frame.

7. The method of claim 1 wherein said examining further comprises counting the number of times that the same color appears in a selected run of pixels in a display frame, deciding that the image is a computer graphics image if said number of times is greater than a first threshold amount, and deciding that the image is a continuous tone image if said number of times is less than a second threshold amount.

8. The method of claim 7 wherein said first threshold amount lies in a range between about 4 and about 50 and wherein said second threshold amount lies in a range between about 0% and about 10% of the total number of pixels in the selected run of pixels.

9. The method of claim 8 wherein said selected run of pixels further comprises substantially an entire frame.

10. The method of claim 8 wherein said selected run of pixels further comprises substantially all of at least one line in said frame.

11. The method of claim 8 wherein said selected run of pixels further comprises a portion of a window in said frame.

12. The method of claim 1 wherein said examining further comprises determining a frequency content of a selected run of pixels in a display frame, deciding that the image is a computer graphics image if said frequency content in said selected run of pixels is less than a first threshold amount, and deciding that the image is a continuous tone image if said frequency content is greater than a second threshold amount.

13. The method of claim 12 wherein said first threshold amount lies in a range between about 0% and about 10% of color space and wherein said second threshold amount lies in a range between about 20% and about 100% of color space.

14. The method of claim 13 wherein said selected run of pixels further comprises substantially an entire frame.

15. The method of claim 13 wherein said selected run of pixels further comprises substantially all of at least one line in said frame.

16. The method of claim 13 wherein said selected run of pixels further comprises a portion of a window in said frame.

17. A method for developing gray scale pixels on a computer display comprising:

examining image content data for display on a computer display to determine whether said image content is most likely to a first image type or a second image type; and choosing from among at least two different image processing methods in response to whether said image content data likely comprises the first image type or the second image type;

wherein said examining comprises counting the number of unique colors in a selected run of pixels in a display frame, deciding that the image is a first image type if the number of unique colors is less than a first threshold amount, and deciding that the image is a second image type if the number of unique colors is greater than a first threshold amount.

18. A method for developing gray scale pixels on a computer display comprising:

examining image content data using the number of colors used for display on a computer display to determine whether said image content is most likely to comprise computer graphics, most likely to comprise continuous tone images, or most likely to comprise computer generated images; and choosing a method for processing said image content data in response to whether said image content comprises is most likely to comprise computer graphics, continuous tone, or computer generated images.

19. The method of claim 18 wherein said examining further comprises:

determining a first threshold value and a second threshold value;

counting the number of times that each color appears in a selected run of pixels chosen from a display frame;

determining the number of colors appearing in the selected run of pixels more than a first threshold number of time;

deciding that the image is a computer graphics image if said number of colors is greater than the second threshold amount and less than the third threshold amount;

identifying the image as a computer generated image if said number of colors is greater than the second threshold amount and less than the third threshold amount; and identifying the image as a continuous tone image said number of colors is greater than a third threshold amount.

20. A machine-readable medium on which are stored instructions to perform a method for developing gray scale pixels on a computer display, the method comprising:

examining image content data using the number of colors used for display on a computer display to determine whether said image content is most likely to comprise computer graphics or most likely to comprise continuous tone images; and choosing from among spatial and temporal gray scaling for said image content data in response to whether said image content comprises computer graphics or continuous tone images.

21. A machine-readable medium on which are stored instructions to perform a method for developing gray scale pixels on a computer display, the method comprising:

examining image content data for display on a computer display to determine whether said image content is most likely to a first image type or a second image type; and choosing from among at least two different image processing methods in response to whether said image content more likely comprises the first image type or the second image type; and wherein said examining comprises counting the number of unique colors in a selected run of pixels in a display frame, deciding that the image is a first image type if the number of unique colors is less than a first threshold amount, and deciding that the image is a second image type if the number of unique colors is greater than a first threshold amount.

* * * * *